US009802232B2

(12) United States Patent
Mercer

(10) Patent No.: US 9,802,232 B2
(45) Date of Patent: Oct. 31, 2017

(54) POSITIONING DRIVE SHAFT SUPPORT FOR ROLLER LEVELER

(71) Applicant: Ryan Craig Mercer, Columbiana, OH (US)

(72) Inventor: Ryan Craig Mercer, Columbiana, OH (US)

(73) Assignee: Butech Bliss, Salem, OH (US)

( * ) Notice: Subject to any disclaimer, the term of this patent is extended or adjusted under 35 U.S.C. 154(b) by 206 days.

(21) Appl. No.: 14/679,365

(22) Filed: Apr. 6, 2015

(65) Prior Publication Data

US 2015/0283591 A1 Oct. 8, 2015

Related U.S. Application Data

(60) Provisional application No. 61/976,080, filed on Apr. 7, 2014.

(51) Int. Cl.

| | |
|---|---|
| ***B21B 31/12*** | (2006.01) |
| ***B21B 35/00*** | (2006.01) |
| ***B21D 1/02*** | (2006.01) |
| *B21B 15/00* | (2006.01) |

(52) U.S. Cl.

CPC ..... *B21B 31/12* (2013.01); *B21B 35/00* (2013.01); *B21D 1/02* (2013.01); *B21B 2015/0071* (2013.01)

(58) Field of Classification Search

CPC .. B21B 35/00; B21B 31/12; B21B 2015/0071
USPC ..... 72/162, 164, 165
See application file for complete search history.

(56) References Cited

U.S. PATENT DOCUMENTS

| | | | | |
|---|---|---|---|---|
| 2,790,229 | A | 4/1957 | Hellstrom | |
| 2,963,071 | A | 12/1960 | Krynytzky | |
| 3,327,509 | A | 6/1967 | Roesch | |
| 5,796,013 | A | 8/1998 | Nagata et al. | |
| 6,848,289 | B1 | 2/2005 | Bergman et al. | |
| 7,637,133 | B2 | 12/2009 | Buta | |
| 2012/0055220 | A1* | 3/2012 | Chazal | B21D 1/02 72/237 |

* cited by examiner

*Primary Examiner* — R. K. Arundale
*Assistant Examiner* — Mohammad Yusuf
(74) *Attorney, Agent, or Firm* — Fay Sharpe LLP; James E. Scarbrough

(57) ABSTRACT

A roller leveler assembly has a first cassette having a first set of work rolls of a first diameter and work roll spacing and a second cassette having a second set of work rolls of a second diameter and work roll spacing. A drive mechanism selectively drives one of the first cassette of the first set of rolls and the second cassette of the second set of rolls. The drive mechanism has a first set of upper drive shafts and a second set of lower drive shafts and a drive shaft support assembly. The drive shaft support assembly has a first support shaft for supporting the first set of upper drive shafts and a second support shaft for supporting the second set of lower drive shafts. The first support shaft and second support shaft each has a first set of saddles and a second set of saddles for supporting the first set of upper drive shafts and the second set of lower drive shafts in first and second positions corresponding to the work roll center spacing of the first set of work rolls and the second set of work rolls, respectively.

21 Claims, 6 Drawing Sheets

POSITIONING DRIVE SHAFT SUPPORT FOR ROLLER LEVELER

CLAIM OF PRIORITY

This application claims priority from provisional application Ser. No. 61/976,080, filed on Apr. 7, 2014, the entirety of which is incorporated by reference herein.

BACKGROUND OF THE DISCLOSURE

The present embodiment relates to roller levelers. It finds particular application in conjunction with cassette roller levelers which have and use two different roll cartridges or cassettes which have rolls of different diameters and roll center distances. An example of a roller leveler which may be used with the present disclosure is shown in U.S. Pat. No. 7,637,133 which is hereby incorporated by reference and will be described with particular reference thereto. However, it is to be appreciated that the present embodiment is also amenable to other like applications.

Metal is formed into strips by a process known as rolling, wherein the strip is passed between a pair of work rolls of a rolling mill to reduce its cross-sectional thickness. In the process, the strip is elongated and rolling continues until the strip is reduced to the cross-sectional thickness desired. This rolling process may start with heated billets or slabs of metal, wherein the metal is rolled at a very high temperature, or it may start with previously rolled strip wherein the strip is passed between work rolls in the cold state. In either event, when the strip exits from the mill, it may be convolutedly wrapped to form a coil. It is well established that the flatter the strip is prior to a subsequent manufacturing operation, the more accurate and satisfactory will be the end product of that operation. Thus, even where portions of steel strip are deep drawn, they do not draw as satisfactorily if the strip initially is not substantially flat before the draw.

A cassette roller leveler used to flatten and level metal strips typically includes multiple pairs of offset work rollers or rolls which are positioned within one or more cassettes or cartridges which can be changed out in the roller leveler. Different size levelers can have different quantities of work rolls and back-up rolls. For example, the upper rolls can be offset one-half the distance between a pair of adjacent lower rolls. A metal strip passes between the upper and lower rolls to be leveled. The number and spacing of the rolls depend on the thickness and strength of the metal strip. Typically, as the strip thickness decreases, the spacing of the rolls, as well as the roll diameter, decrease. As the strip passes between the rolls, it is bent up and down multiple times before it exits the leveler. This reverse bending beyond the yield point of the material is the mechanism whereby the strip is flattened.

Existing cassette levelers use one main frame to house two different roll cartridges, which have rolls with different diameters and center distances. To make for a more economical design, these machines use one set of motors/reducers to drive whichever cartridge currently resides in the machine. During changing out of the cartridges, the portions of the drive shafts that remain with the reducers need to be supported by a positioning spindle support that is designed to support the drive shafts as well as individually change the position of each drive shaft to accommodate the desired cartridge and the position and diameter of the rolls of the cartridge. Most existing cassette levelers pull the drive shaft out with the work roll cassettes. This method requires extra space (because of drive shaft length) and is more expensive because two (2) sets of drive shafts are required.

Thus, there is a need for a roller leveler with common different roll cartridges which has a drive shaft positioning support which shifts the location of drive shafts during cartridge exchanges to match the roll centers of the cartridge being inserted and which overcomes the above-mentioned deficiencies while providing better and more advantageous overall results.

BRIEF DESCRIPTION OF THE DISCLOSURE

The present disclosure relates to roller levelers. It finds particular application in conjunction with cassette roller levelers which have two different roll cartridges which have rolls of different diameters and different center distances. Specifically, the apparatus of the present disclosure is a drive shaft support that shifts the location of drive shafts during cartridge exchanges to match the roll centers of the cartridge being inserted.

In a typical roller leveler, upper work rollers and lower work rollers are individually driven by drive shafts. There are lower back-up roller mounting beams evenly spaced along the span of the lower work rollers, each mounting beam carrying a flight of lower back-up rollers extending from front to rear of the roller leveler. The back-up rollers are spaced so that each flight provides two back-up rolls in tangential contact with each lower work roll.

Cassette levelers utilize one main frame which houses two different roll cartridges, where each cartridge has rolls with different diameters and different center distances. They also feature one set of drive motors/reducers to drive whichever cartridge is installed in the machine. When it is desired to change the cartridge, the drive shafts need to be supported in such a manner so they are able to change position to accommodate the desired cartridge roll position.

Thus, in order to support the drive shafts, a positioning drive shaft support, in accordance with a preferred embodiment of the disclosure, includes two support shafts, i.e., an upper support shaft for the upper drive shafts and a lower support shaft for the lower drive shafts. Each support shaft preferably has an upper and lower row of grooves or notches called saddles, preferably 180 degrees apart, corresponding to the elevation, horizontal position, and angle of the drive shafts required for each of the two cartridges. In order to change the position of the drive shafts to accommodate the desired cartridge, spiral grooves are additionally machined in the support shafts between and connecting the saddles, which act to guide the drive shafts from one saddle to the other saddle. Finally, the ends of the support shafts are mechanically tied together via a gear drive mechanism and rotated to move the drive shafts from one saddle of the support shaft to another saddle of the support shaft while the cartridges are out of the leveler.

Various embodiments of the disclosure will now be described below. These embodiments are to be considered non-limiting and other embodiments are also contemplated by the disclosure.

In accordance with one embodiment of the disclosure, a roller leveler assembly has a first cassette having a first set of work rolls of a first diameter and work roll center distance; a second cassette having a second set of work rolls of a second diameter and work roll center distance; a drive mechanism which selectively drives one of the first cassette of the first set of rolls and the second cassette of the second set of rolls; the drive mechanism has a first set of upper drive shafts and a second set of dower drive shafts and a drive shaft support assembly. The drive shaft support assembly has a first support shaft for supporting the first set of upper drive shafts and a second support shaft for supporting the second set of lower drive shafts. The first upper support shaft and second lower support shaft each has a first set of upper saddles and a second set of lower saddles for supporting the first set of upper drive shafts and the second set of lower drive shafts in first and second positions corresponding to the diameters and center distances of the first set of work rolls and the second set of work rolls, respectively.

In accordance with another embodiment of the disclosure, a roller leveler assembly has a first cassette including a first set of work rolls of a first diameter; a second cassette comprising a second set of work rolls of a second diameter; and a drive mechanism which selectively drives one of the first cassette of the first set of rolls and the second cassette of the second set of rolls.

The drive mechanism includes a first set of upper drive shafts and a second set of lower drive shafts and a drive shaft support assembly. The drive shaft support assembly has a first support shaft for supporting the first set of upper drive shafts and a second support shaft for supporting the second set of lower drive shafts, wherein the first support shaft has a set of first notches and a second set of notches for supporting the first set of upper drive shafts in first and second positions, and the second support shaft has a first set of notches and a second set of notches for supporting the second set of lower drive shafts in first and second positions, respectively. The first and second positions correspond to first and second work roll diameters and first and second work roll distances of the first and second set of work rolls.

Another embodiment of the disclosure is a positioning drive shaft support for upper and lower drive shafts for a roller leveler which shifts the location of the drive shafts during cartridge exchanges so that the drive shafts are aligned with the roll centers of the work rolls of the new cartridge being inserted.

Another embodiment of the disclosure is upper and lower support shafts each having upper and lower saddles on opposed sides which correspond to elevation, horizontal position and angle of the drive shafts.

Yet another embodiment of the disclosure are spiral grooves machined between upper and lower saddles of the support shafts to guide the drive shafts between upper and lower saddles.

Another embodiment of the disclosure is as the drive shafts rotate from one saddle to the other on a support shaft, the drive shafts shift laterally. This accommodates the change in roll center distance between the two work roll cassettes.

Another embodiment of the disclosure is that as the drive shafts rotate from one saddle to the other on a support shaft, the drive shafts shift vertically. This accommodates the fact that the smaller diameter work rolls operate at closer vertical gaps than the large rolls hence the drive shaft vertical spacing needs to change as well.

Another embodiment of the disclosure is the drive shaft support rotates about a fixed center as it goes from an upper saddle to a lower saddle since the upper saddle is at a different radial distance (height) than the lower saddle. This vertical height adjustment between saddles is important to the lateral shift of the drive shafts.

Still other embodiments and aspects of the disclosure will become apparent upon a reading and understanding of the following detailed description.

DETAILED DESCRIPTION OF THE DISCLOSURE

The present disclosure relates to roller levelers. It finds particular application in conjunction with cassette roller levelers which have two different roll cartridges which have rolls of different diameters and different center distances. Specifically, the apparatus of the present disclosure is a drive shaft positioning support that supports and shifts the location of drive shafts during cartridge exchanges to match the roll centers of the particular cartridge being inserted.

Figure 1:
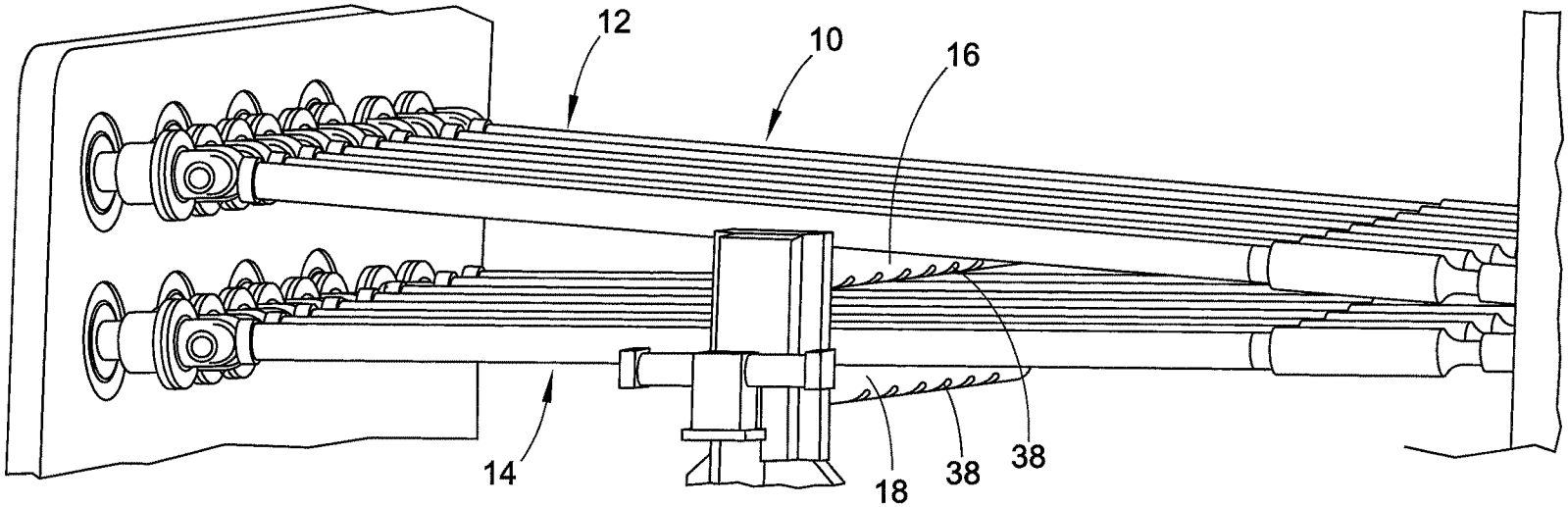
FIG. 1 is a perspective view of a drive shaft positioning device in accordance with a preferred embodiment of the disclosure.
Figure 2:
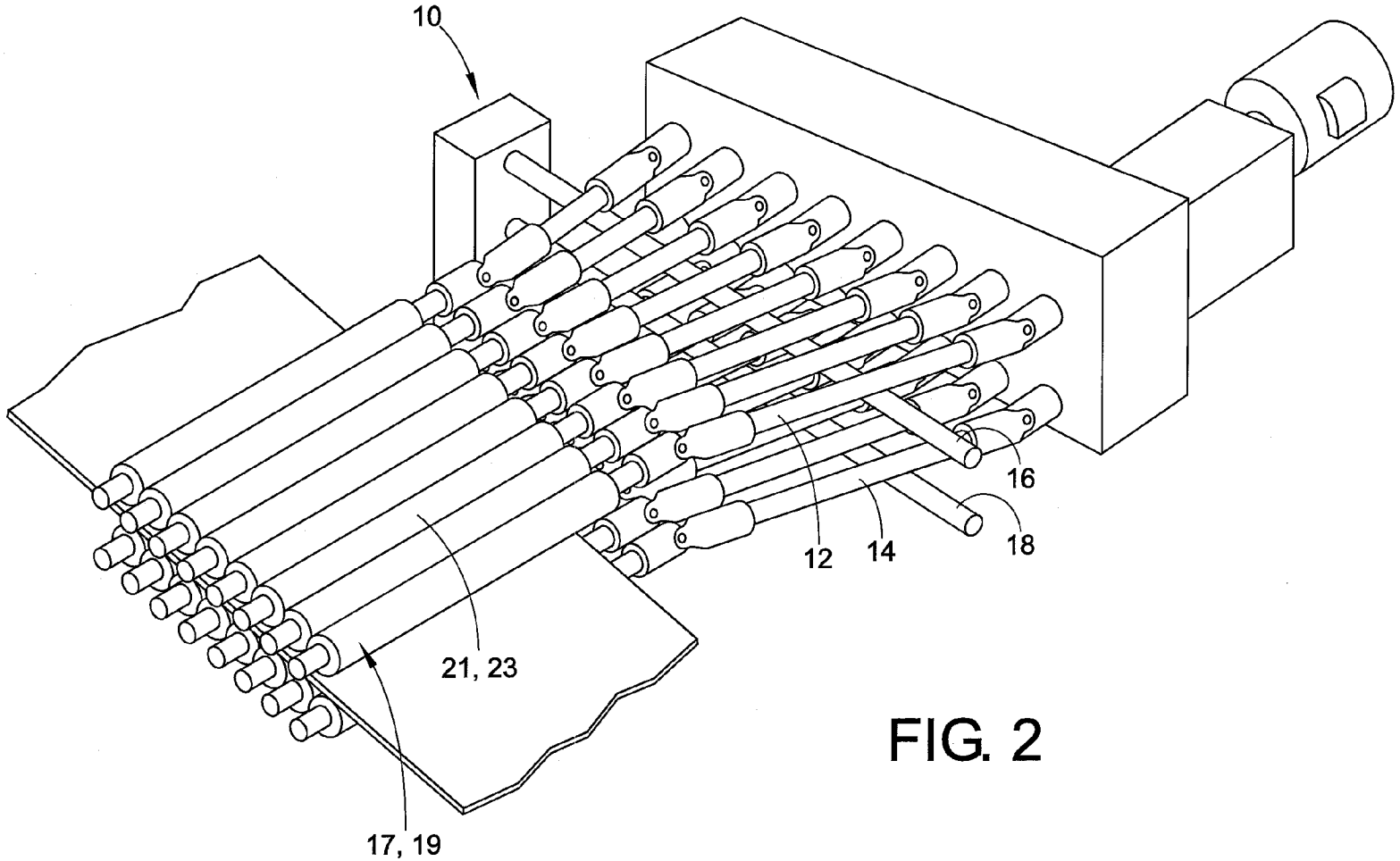
FIG. 2 is another perspective view of a drive shaft positioning device of FIG. 1.

In order to support the drive shafts, referring to FIG. 1, a preferred embodiment of the disclosure is shown. A positioning drive shaft support 10 includes two support shafts 16, 18, i.e., a first or upper support shaft 16 for supporting a first set of upper drive shafts 12 and a second or lower shaft 18 for supporting a second set of lower drive shafts 14. Referring to FIG. 2, upper and lower drive shafts 12, 14 are rotatably connected to a first cartridge or cassette 17 of work rolls 21 or to a second cartridge or cassette 19 of work rolls 23. The drive shafts can be equally spaced apart and can be parallel to each other or at slight angles to each other. First cassette 17 includes work rolls 21 of a first diameter and spacing configuration, while the second cassette 19 includes work rolls 23 of a second diameter and spacing configuration which is different than the first diameter and spacing of work rolls 21. In the preferred embodiment, there are eight upper and lower work rolls 21, 23, but other numbers and configurations are contemplated by the disclosure.

Referring to FIGS. 3A-3C and 4A-4C, each upper and lower support shaft 16, 18 preferably has an upper and lower row of grooves or notches called saddles 36, 38, preferably spaced about 180 degrees apart, corresponding to the elevation, horizontal position, and angle of the drive shafts required for each of the two cartridges 17, 19. The saddles can be preferably evenly spaced along the longitudinal axis of the shafts 16, 18. The lower set of saddles is offset from the upper set of saddles to facilitate both lateral and vertical shifting of the drive shafts between first and second positions corresponding to roll center distances of first and second roll cartridges.

As the drive shaft support shafts 16, 18 rotate from one saddle 36 position to the other saddle 38 position, two things happen. First, the drive shafts 12, 14 shift laterally. This accommodates the change in roll center distance between the two work roll cassettes 17, 19. Second, the drive shafts 12, 14 shift vertically. This accommodates the fact that the smaller diameter work rolls operate at closer vertical gaps than the large rolls hence the drive shaft vertical spacing needs to change as well. The support shafts 16, 18 rotate about a fixed center as they go from saddle 36 to saddle 38. Saddle 36 is at a different radial distance (height) than saddle 38. This vertical height adjustment between saddle 36 and saddle 38 is facilitates the lateral shift of the drive shafts 12, 14.

Further, in order to change the position of the drive shafts to accommodate the desired cartridge, spiral grooves 40 are additionally machined in the support shafts 16, 18 between the upper and lower saddles 36, 38 thereby connecting upper saddle to lower saddle, which act to guide or shift the drive shafts from one saddle to the other. Finally, the ends of the support shafts are mechanically tied together via a gear drive mechanism and rotated to move the drive shafts from one saddle of the support shaft to another saddle of the support shaft while the cartridges are out of the leveler.

Figure 3A:
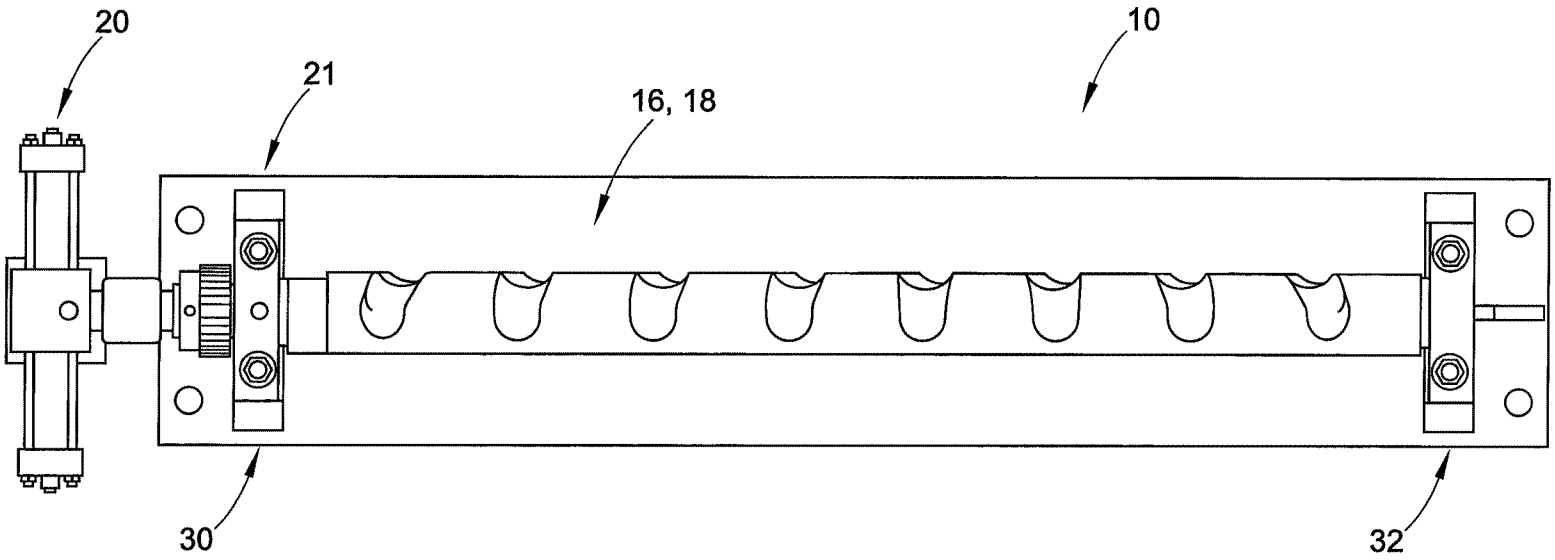
FIG. 3A is a top plan view of a spindle support arrangement.
Figure 3B:
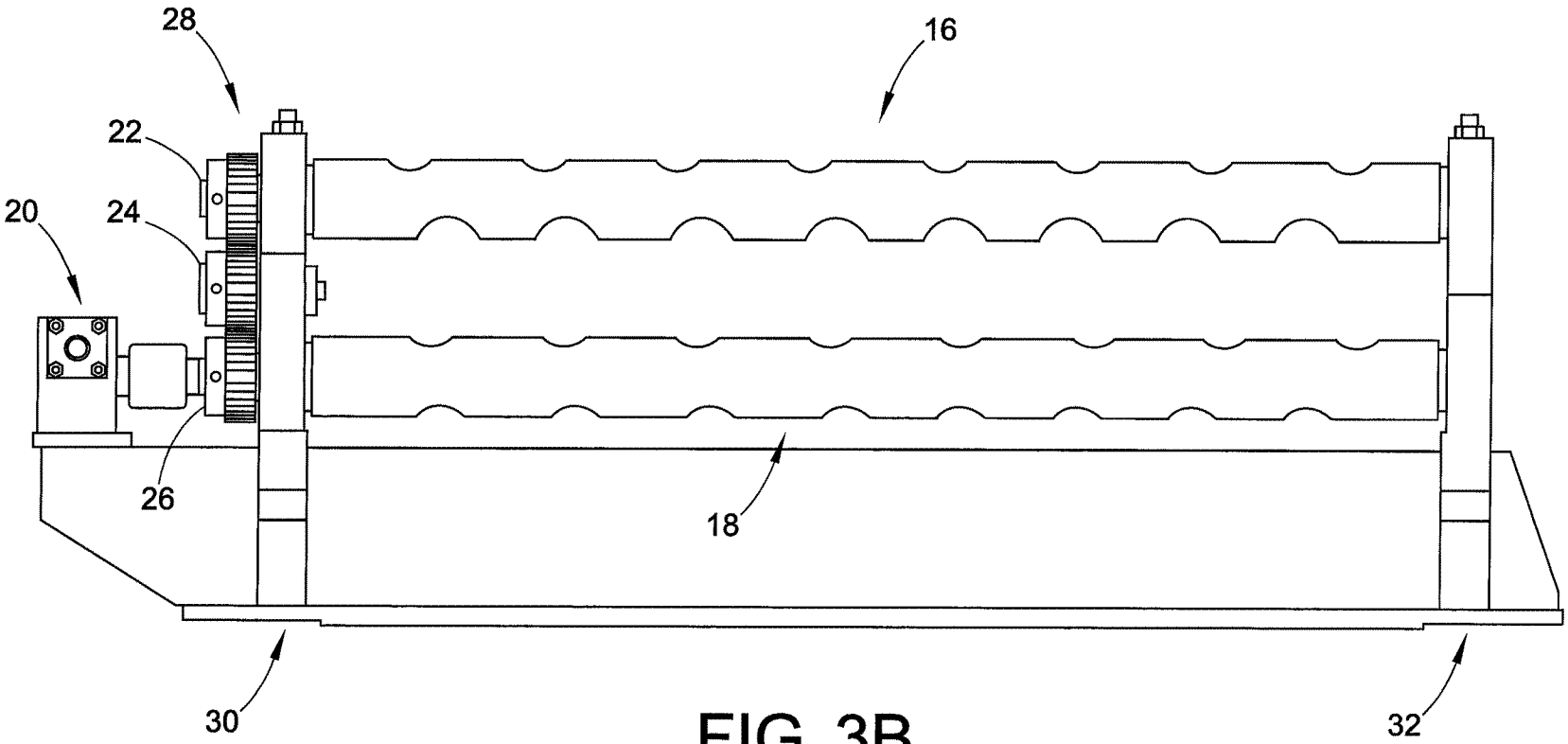
FIG. 3B is a side elevational view of the spindle support arrangement of FIG. 3A.
Figure 3C:
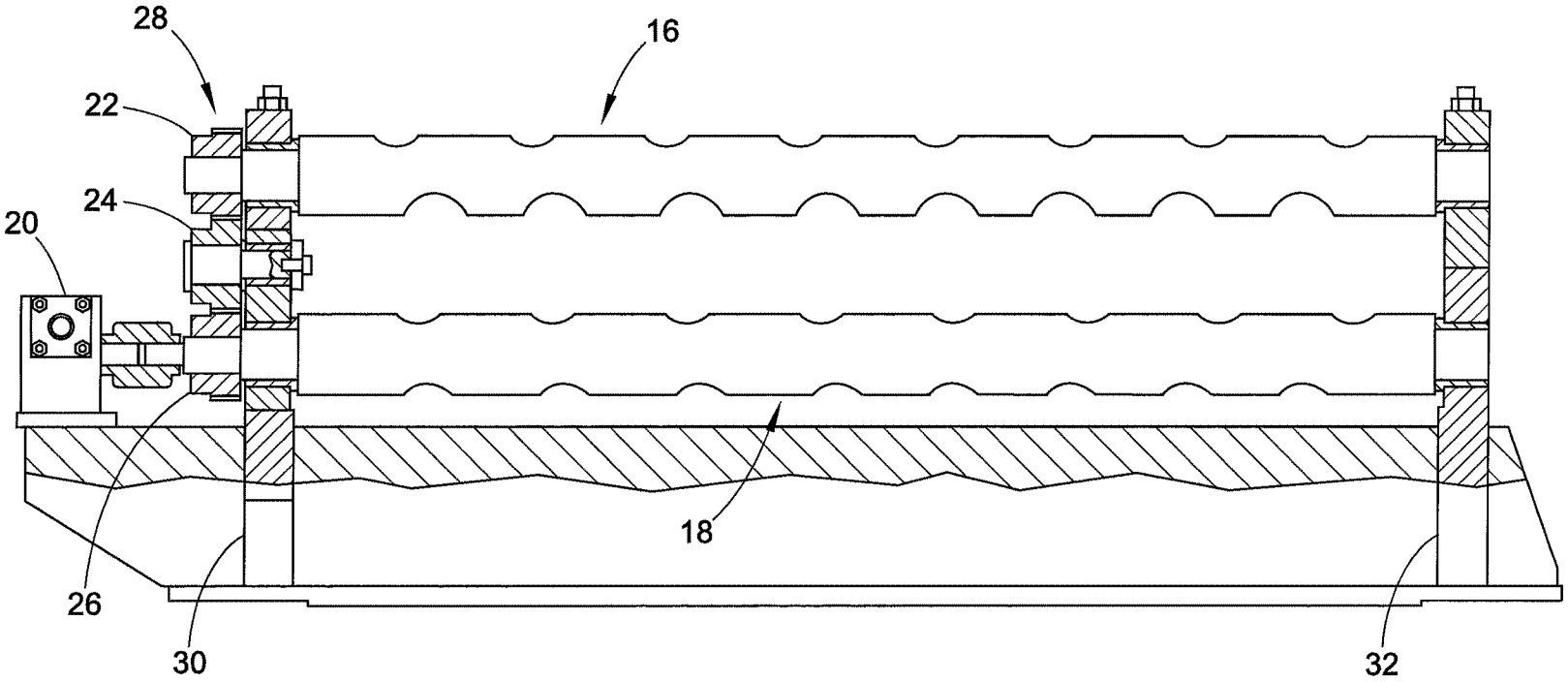
FIG. 3C is a side elevational view in cross section of the spindle support arrangement of FIG. 3A.

Referring specifically now to FIGS. 3A-3C, the spindle support arrangement including support shafts 16, 18 are shown in more detail. Hydraulic actuating cylinders 20 are mounted at one distal end 21 of a spindle support shaft 16, 18. Referring to FIG. 3B, a series of gears 22, 24, 26 spaced in a vertical orientation are rotatably connected to the hydraulic cylinder 20 to form a gear drive arrangement 28 for rotating the upper and lower spindle support shafts 16, 18 which are parallel to each other and in turn are supported on opposite longitudinally spaced apart vertical flange assemblies 30, 32. As seen in FIG. 2, in the preferred embodiment, there are eight upper drive shafts 12 and eight lower drive shafts 14. However, other configurations and numbers of drive shafts are contemplated by the disclosure.

Figure 4A:
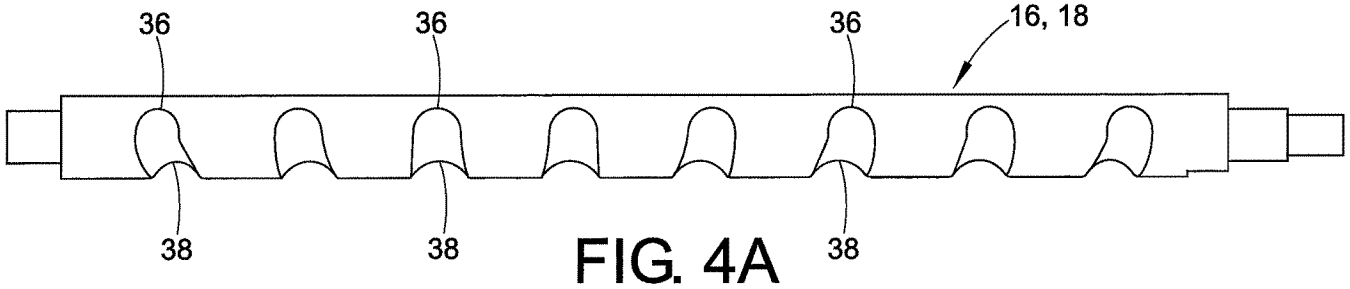
FIG. 4A is a top plan view of an upper spindle support shaft of the device of FIGS. 1 and 2.
Figure 4B:
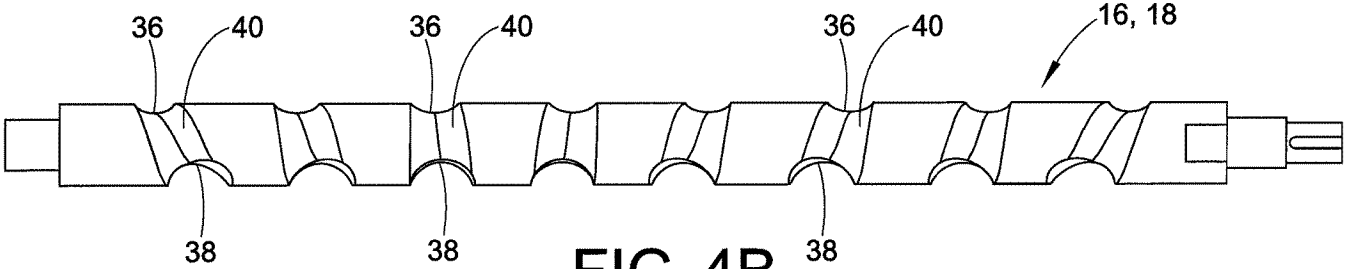
FIG. 4B is a side elevational view of the upper spindle support shaft of FIG. 4A.
Figure 4C:
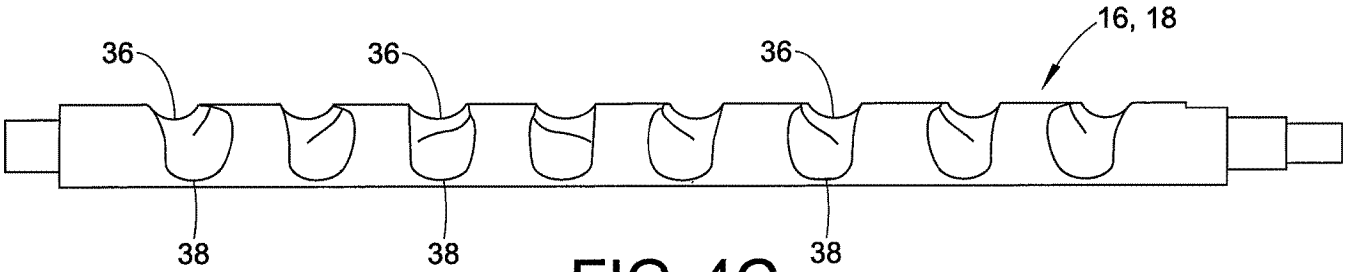
FIG. 4C is a bottom plan view of the upper spindle support shaft of FIG. 4A.

Referring now to FIGS. 4A-4C, detailed views of the support shafts 16, 18 are shown. Each support shaft 16, 18 has a row of spaced apart upper and lower saddles 36, 38 located or positioned substantially 180 degrees apart. Each row of saddles is configured to correspond to the elevation, horizontal position, and angle of the drive shafts, among other factors, required for each of the two roller cartridges. Straight grooves are machined into the shafts 16, 18 to form the opposed drive shaft saddles 36, 38. Then, offset spiral grooves 40 are machined in the support shafts interposed between and connecting the opposed offset saddles 36, 38, which act to guide or move the drive shafts laterally and vertically from one saddle to the other, for example, from saddle 36 to saddle 38.

The ends of the support shafts are mechanically tied together and rotated via gear drive assembly 28 to move the drive shafts 12, 14 from a first position corresponding to the first saddle 36 to a second position corresponding to the second saddle 38 while the cartridges are out of the leveler. Specifically, as the support shafts 16, 18 are rotated by the gear assembly 28, the drive shafts 12, 14 which are supported by the saddles 36 on the upper end of the spindles 16, 18 slide along the offset spiral grooves 40 which connect the upper saddles 36 to the lower saddles 38 which are offset with respect to the upper saddles 36. Thus, the drive shafts 10, 12 are laterally and vertically shifted from a first position (at saddle 36) corresponding to a first roll 17 diameter and spacing to a second position (at saddle 38) corresponding to a second roll 19 diameter and spacing. The support shafts are positioned to laterally extend between adjacent drive shafts at approximately 90 degrees. In other words, the longitudinal axis of each support shafts are positioned at about 90 degrees with respect to the longitudinal axis of each of the drive shafts. The support shafts can be parallel to each other and spaced apart in a vertical orientation.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the above disclosure and appended claims or the equivalents thereof.

The invention claimed is:

1. A roller leveler assembly, comprising:

a first cassette comprising a first set of work rolls of a first diameter;

a second cassette comprising a second set of work rolls of a second diameter;

a drive mechanism which selectively drives one of said first cassette of said first set of rolls and said second cassette of said second set of rolls;

said drive mechanism comprising a first set of drive shafts and a second set of drive shafts and a drive shaft support assembly, comprising:

a first support shaft for supporting said first set of drive shafts, wherein said first support shaft comprises at least one first saddle and at least one second saddle for supporting said first set of drive shafts in first and second positions corresponding to said first diameter of said first set of work rolls and to said second diameter of said second set of work rolls, respectively;

wherein when said first support shaft is rotated, said first set of drive shafts laterally and vertically shift from said at least one first saddle to said at least one second saddle.

2. The roller leveler assembly of claim 1, wherein said first position of said first set of drive shafts aligns said first set of drive shafts with said first set of work rolls and said second position of said first set of drive shafts aligns said first set of drive shafts with said second set of work rolls.

3. The roller leveler assembly of claim 1, wherein said first set of drive shafts comprises eight drive shafts.

4. The roller leveler assembly of claim 1, further comprising a second support shaft for supporting said second set of drive shafts, said second support shaft comprises at least one first saddle and at least one second saddle for supporting said second set of drive shafts in first and second positions, respectively.

5. The roller leveler assembly of claim 4, wherein said second set of drive shafts comprises eight drive shafts.

6. The roller leveler assembly of claim 4, wherein said first position of said second set of drive shafts aligns said second set of drive shafts with said first set of work rolls and said second position of said second set of drive shafts aligns said second set of drive shafts with said second set of work rolls.

7. The roller leveler assembly of claim 1, wherein said first support shaft is positioned approximately perpendicular to said first set of drive shafts.

8. The roller leveler assembly of claim 4, wherein said second support shaft is positioned approximately perpendicular to said second set of drive shafts.

9. The roller leveler assembly of claim 3, wherein said first support shaft comprises eight first saddles and eight second saddles.

10. The roller leveler assembly of claim 1, wherein said at least one first saddle and said at least one second saddle are positioned substantially on opposite sides of said first support shaft.

11. The roller leveler assembly of claim 9, wherein said first saddles and said second saddles are positioned on substantially opposite sides of said first support shaft.

12. The roller leveler assembly of claim 5, wherein said second support shaft comprises eight first saddles and eight second saddles.

13. The roller leveler assembly of claim 1, wherein said at least one first saddle and said at least one second saddle of said first support shaft are offset from one another in a longitudinal direction.

14. The roller leveler assembly of claim 13, wherein said at least one first saddle and said at least one second saddle of said first support shaft are offset from one another in a vertical direction.

15. The roller leveler assembly of claim 14, further comprising a groove extending between and connecting said at least one first saddle of said first support shaft to said at least one second saddle of said first support shaft.

16. The roller leveler assembly of claim 4, wherein said at least one first saddle of said second support shaft and said at least one second saddle of said second support shaft are offset from one another in a longitudinal direction.

17. The roller leveler assembly of claim 16, wherein said at least one first saddle of said second support shaft and said at least one second saddle of said second support shaft are offset from one another in a vertical direction.

18. The roller leveler assembly of claim 17, further comprising a groove extending between and connecting said at least one first saddle of said second support shaft to said at least one second saddle of said second support shaft.

19. The roller leveler assembly of claim 4, wherein said first support shaft and said second support shaft are connected to and driven by a drive gear assembly.

20. A roller leveler assembly, comprising:

a first cassette comprising a first set of work rolls of a first diameter;

a second cassette comprising a second set of work rolls of a second diameter;

a drive mechanism which selectively drives one of said first cassette of said first set of rolls and said second cassette of said second set of rolls;

said drive mechanism comprising a first set of drive shafts and a second set of drive shafts and a drive shaft support assembly, comprising:

a first support shaft for supporting said first set of drive shafts, wherein said first support shaft comprises at least one first saddle and at least one second saddle for supporting said first set of drive shafts in first and second positions, respectively;

a second support shaft for supporting said second set of drive shafts, said second support shaft comprises at least one first saddle and at least one second saddle for supporting said second set of drive shafts in first and second positions, respectively;

wherein said first support shaft and said second support shaft are connected to and are driven by a drive gear assembly;

wherein when said first support shaft and said second support shaft are rotated by said drive gear assembly, said first set of drive shafts laterally and vertically shift from said at least one first saddle to said at least one second saddle of said first upper support shaft and said second set of drive shafts shift from said at least one first saddle to said at least one second saddle of said second support shaft.

21. A roller leveler assembly, comprising:

a first cassette comprising a first set of work rolls of a first diameter and a first spacing;

a second cassette comprising a second set of work rolls of a second diameter and a second spacing;

a drive mechanism which selectively drives one of said first cassette of said first set of rolls and said second cassette of said second set of rolls;

said drive mechanism comprising a first set of drive shafts and a second set of drive shafts and a drive shaft support assembly, comprising:

a first support shaft for supporting said first set of drive shafts and a second support shaft for supporting said second set of drive shafts, wherein said first support shaft comprises a set of first notches and a second set of notches for supporting said first set of drive shafts in first and second positions, and said second support shaft comprises a first set of notches and a second set of notches for supporting said second set of drive shafts in first and second positions, wherein said first and second positions of said first drive shafts and first and second positions of said second set of drive shafts correspond to said first set of work rolls and said second set of work rolls, respectively;

wherein when said first support shaft and said second support shaft are rotated, said first set of drive shafts laterally and vertically shift from said first set of notches to said second set of notches of said first support shaft and said second set of drive shafts laterally and vertically shift from said first set of notches to said second set of notches of said second support shaft.

* * * * *